United States Patent [19]

Taylor et al.

[11] Patent Number: 4,765,287

[45] Date of Patent: Aug. 23, 1988

[54] SLIDE VALVE APPARATUS FOR INTERNAL COMBUSTION ENGINE

[76] Inventors: Bill A. Taylor, Rte. 2, Greenbrier, Tenn. 37073; Talton O. McMahan, Jr., Rte. 1, Pleasant View, Tenn. 37146

[21] Appl. No.: 115,344

[22] Filed: Nov. 2, 1987

[51] Int. Cl.[4] ..... F01L 7/06

[52] U.S. Cl. ..... 123/81 D; 123/188 B; 123/315; 123/432

[58] Field of Search ..... 123/65 V, 73 D, 81 R, 123/81 D, 188 B, 432, 315

[56] References Cited

U.S. PATENT DOCUMENTS

| | | | |
|---|---|---|---|
| Re. 13,905 | 4/1915 | Murphy | 123/188 B |
| 1,273,002 | 7/1918 | Samuels | 123/81 D |
| 1,537,248 | 5/1925 | Maloney | 123/188 B |
| 1,818,527 | 8/1931 | Becker | 123/188 B |
| 1,877,760 | 9/1932 | Berner et al. | 123/81 D |
| 2,201,292 | 5/1940 | Hickey | 123/188 B |
| 2,302,442 | 11/1942 | Hickey | 123/188 B |
| 2,409,350 | 10/1946 | Forrest | 123/188 R |

*Primary Examiner*—Willis R. Wolfe

*Attorney, Agent, or Firm*—Harrington A. Lackey

[57] ABSTRACT

A valve apparatus for an internal combustion engine includes an intake valve plate and an exhaust valve plate mounted side-by-side for longitudinal reciprocable, slidable movement over the mouth or opening of the combustion cylinder. Each of the slidable valve plates includes a plurality of longitudinally spaced movable valve ports which are adapted to register with corresponding fixed valve ports in the valve head on the opposite side of the slidable valve plates from the engine cylinder.

10 Claims, 3 Drawing Sheets

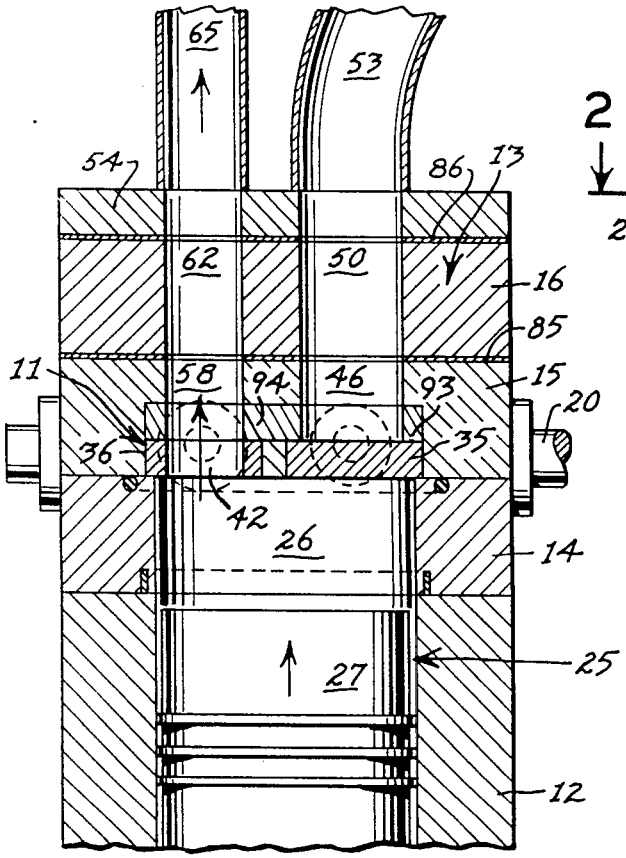
FIG. 3
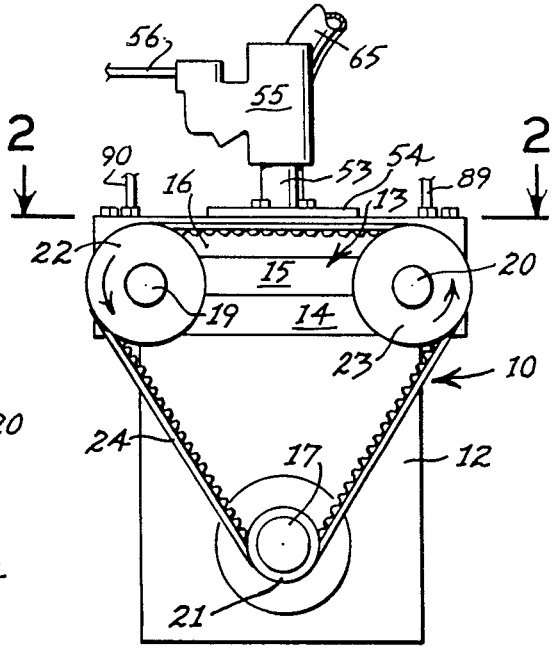
FIG. 1
FIG. 2
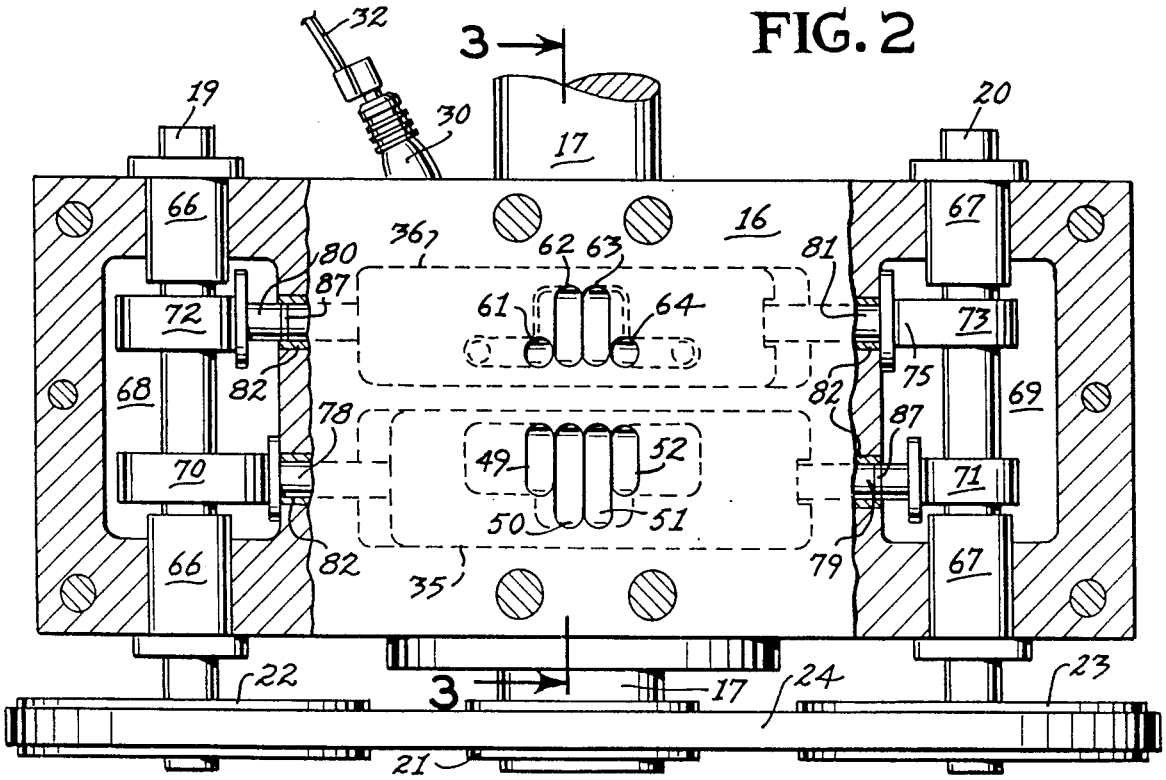

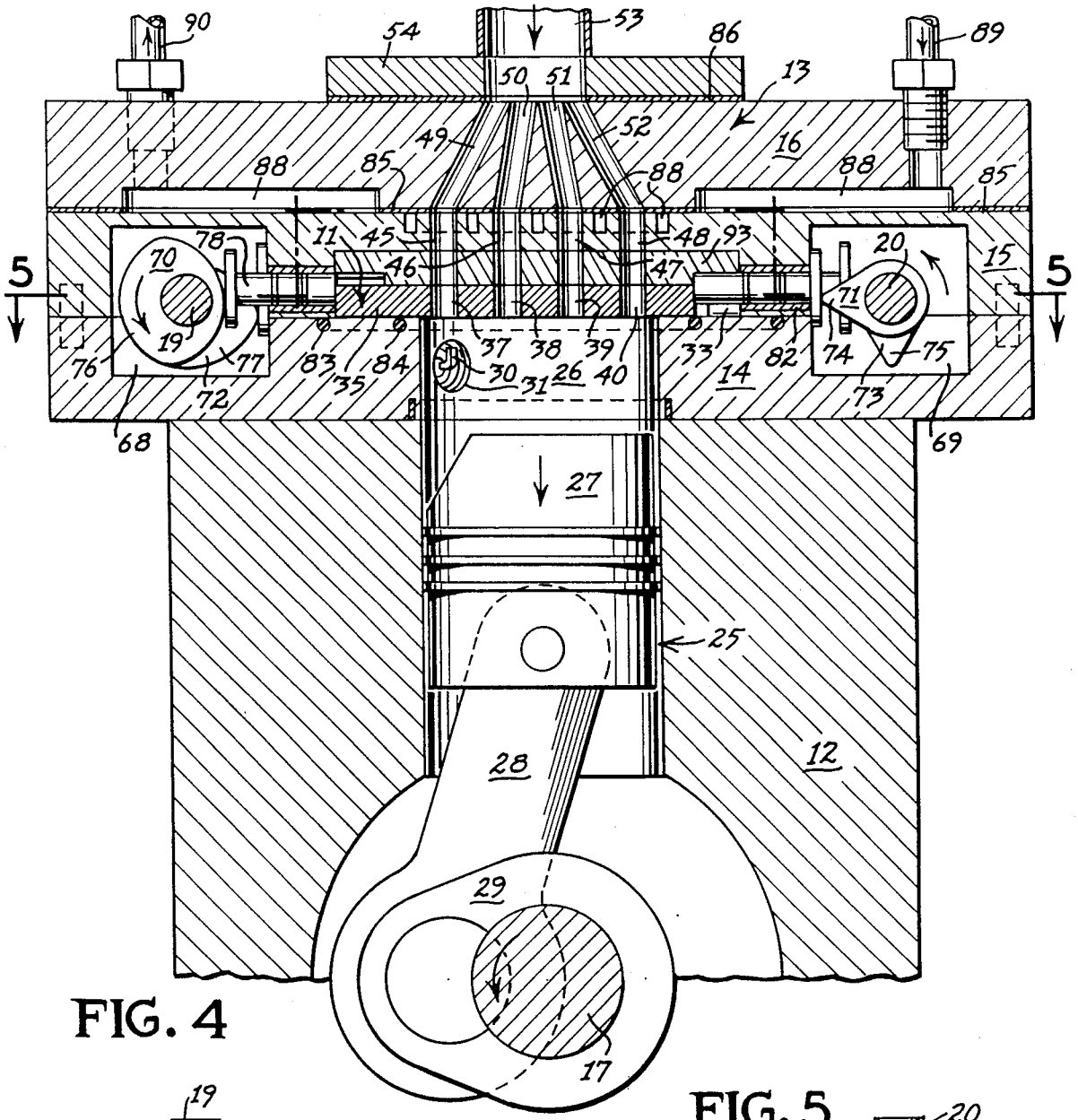
FIG. 4
FIG. 5
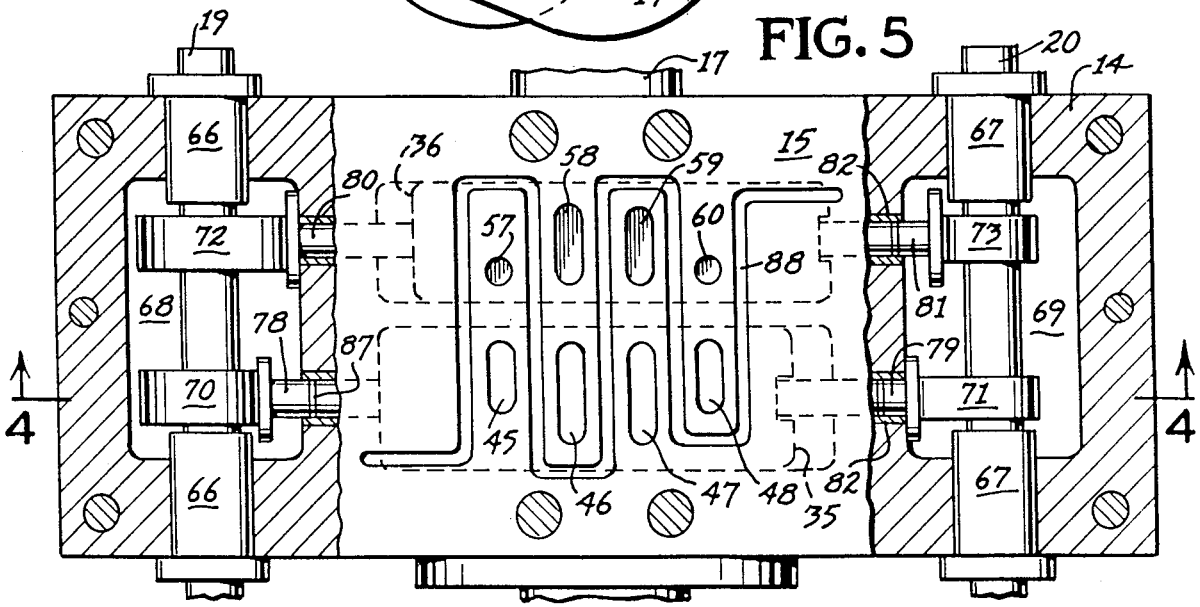

SLIDE VALVE APPARATUS FOR INTERNAL COMBUSTION ENGINE

BACKGROUND OF THE INVENTION

This invention relates to a slide valve apparatus for an internal combustion engine, and more particularly to a slide valve apparatus incorporating side-by-side intake and exhaust slide valves.

Conventionally, most internal combustion engines utilize reciprocable tappet valves for controlling the fuel intake and the gas exhaust cycles of an internal combustion engine. Since the tappet valves reciprocably move into the cylinder, they are subjected to contact and damage by the reciprocating piston. Accordingly, the piston travel must be limited to avoid such contact with the tappet valves.

Slide valves for controlling the intake and exhaust of internal combustion engine cylinders are known, as shown in the following U.S. Pat. Nos.:

Re. 13,905; Murphy; Apr. 27, 1915
1,256,720; Murray; Feb. 19, 1918
1,273,002; Samuels; July 16, 1918
1,374,140; Dock; Apr. 5, 1921
1,476,359; Ford; Dec. 4, 1923
1,492,587; Toth; May 6, 1924
1,537,248; Maloney; May 12, 1925
1,562,461; Maloney; Nov. 24, 1925
4,119,077; Vallejos; Oct. 10, 1978
4,201,174; Vallejos; May 6, 1980

The Murray U.S. Pat. No. 1,256,720, the Samuels U.S. Pat. No. 1,273,002, and the Dock U.S. Pat. No. 1,374,140 disclose single horizontal, flat sliding valve plates.

The Murphy U.S. Pat. No. Re. 13,905, both Maloney U.S. Pat. Nos. 1,537,248 and 1,562,461 and the Vallejos U.S. Pat. No. 4,201,174 (FIGS. 14, 15, and 16) disclose dual horizontal sliding plates, one above the other.

The Ford U.S. Pat. No. 1,476,359 discloses a vertically slidable valve plate.

The Toth U.S. Pat. No. 1,492,587 (FIGS. 4 and 5) and both Vallejos U.S. Pat. Nos. 4,119,077 and 4,201,174 disclose dual slide valve plates which operate side-by-side in response to cam or eccentric linkage for periodically opening and closing the mouth or opening of the internal combustion engine cylinder, in order to control the intake and exhaust gas flow.

In the slide valve apparatus disclosed in FIGS. 1-3 of the Toth patent, a single slide valve 11 incorporating a pair of openings 19 and 21 is moved between a pair of walls, the lower one of which forms the top wall of the combustion chamber in which only a single opening 21 is formed. Two openings are required in the single slide valve 11 for controlling both the intake and the exhaust gases from the cylinder.

In the twin plate valve apparatus disclosed in FIGS. 4 and 5 of the Toth patent, only a single opening 121 for valve 111 and an undisclosed opening in valve 111*a* are included for alignment with corresponding fixed openings above and below the slide plates or valves.

In FIG. 12 of the Vallejos U.S. Pat. No. 4,119,077 and FIG. 3 of the Vallejos U.S. Pat. No. 4,201,174, only a single opening is formed by the cooperation of the two slidable valve plates 4 for conveying both intake fuel and exhaust gas, as described more fully in col. 11, lines 50-56 of the Vallejos U.S. Pat. No. 4,119,077.

SUMMARY OF THE INVENTION

It is therefore an object of this invention to provide a slide valve apparatus for an internal combustion engine incorporating an intake slide valve plate and an exhaust slide valve plate for periodically opening and closing the mouth of the cylinder for periodic introduction of the fuel on the intake stroke and discharging the exhaust gases on the exhaust stroke, in which a plurality of valve ports are provided in each of the valve plates.

More specifically, each valve plate is provided with a plurality of, and preferably at least four, valve ports which are spaced longitudinally of each valve plate and which occupy a maximum transverse area in communication with the interior of the cylinder.

By providing each valve plate with a plurality of longitudinally spaced valve ports of limited longitudinal dimension and maximum transverse dimension, a maximum amount of fluid may pass through the ports in their open position in a minimum amount of time. A valve plate incorporating a plurality of longitudinally spaced valve ports may be moved longitudinally only a limited distance for fully opening the valve ports, and consequently attaining a maximum flow rate in a minimum of time.

Furthermore, by utilizing intake and exhaust valve plates each having a plurality of longitudinally spaced valve ports, valve plates experience a minimum of wear because of the minimal distance through which they travel on each cycle of the engine.

The maximum number of longitudinally spaced valve ports in each valve plate is limited only by the strength of the material between the valve ports for sustaining the strength, wear and integrity of the valve plates, and by the sealing area between the slide valve and its corresponding valve seats.

BRIEF DESCRIPTION OF THE DRAWINGS

FIG. 1 is an end elevation of an internal combustion engine incorporating this invention;

FIG. 2 is an enlarged fragmentary sectional plan view, with portions broken away, taken along the line 2—2 of FIG. 1;

FIG. 3 is a fragmentary section taken along the line 3—3 of FIG. 2, illustrating the exhaust cycle of the engine;

FIG. 4 is a fragmentary sectional elevation taken along the line 4—4 of FIG. 5, illustrating the intake cycle of the engine;

FIG. 5 is a fragmentary section taken along the line 5—5 of FIG. 4, with portions broken away;

DESCRIPTION OF THE PREFERRED EMBODIMENT

Figure 6:
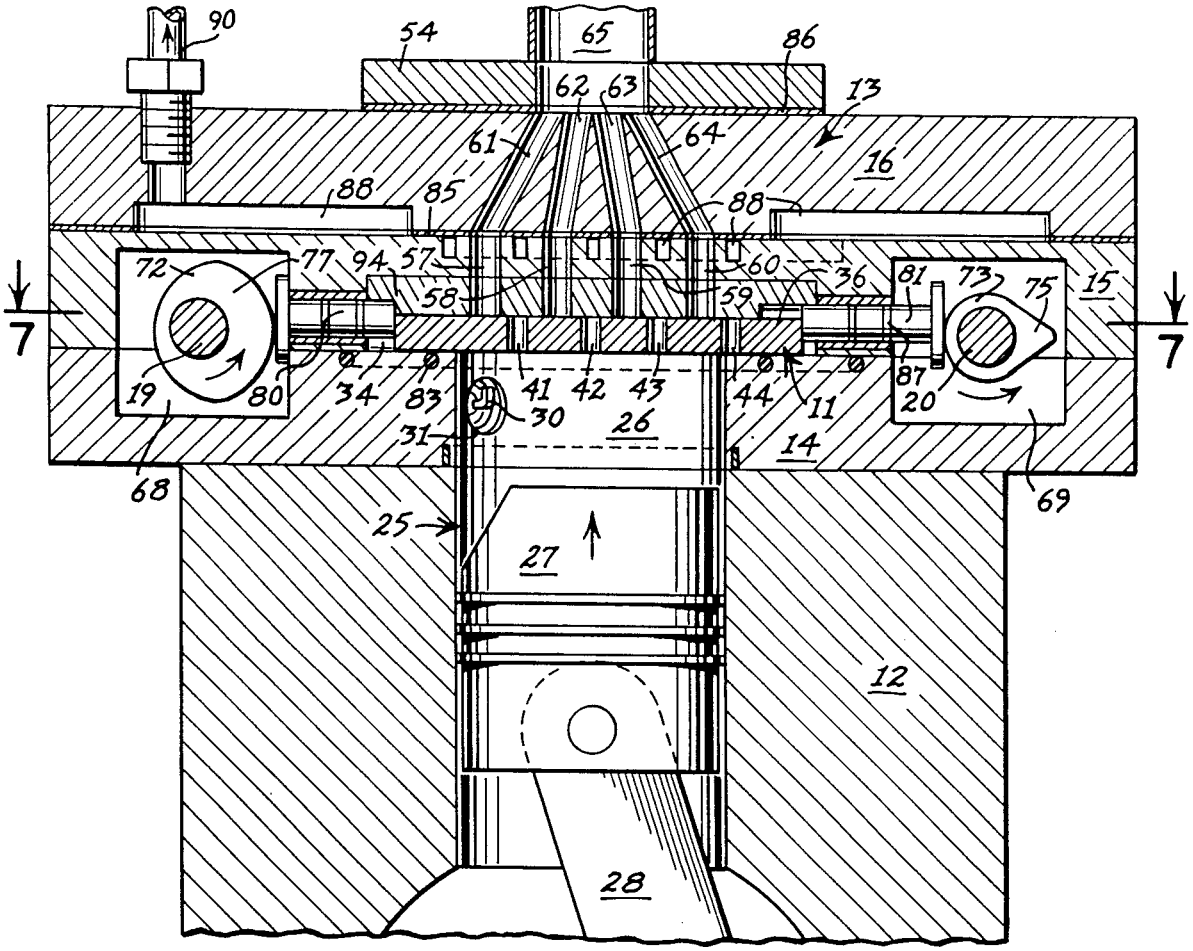
FIG. 6 is a fragmentary sectional elevation taken along the line 6—6 of FIG. 7, and is similar to FIG. 4, but illustrates the compression cycle of the engine.

Referring now to the drawings in more detail, FIG. 1 discloses a portion of an internal combustion engine 10 incorporating this invention and including an engine block 12 capped by a valve head 13 constructed of three laminated head plates 14, 15, and 16.

Journaled within the engine block 12 for rotary movement 11 is the elongated crankshaft 17. Also mounted for rotary movement parallel to the crankshaft 17, and within the valve head 13, are a pair of horizontally spaced rotary cam shafts 19 and 20. Fixed upon each of the crankshaft 17 and cam shafts 19 and 20 is a corresponding cog pulley 21, 22, and 23. Trained around the cog pulleys 21, 22, and 23 is an endless cog belt 24 for simultaneous rotation of the crankshaft 17 and the cam shafts 19 and 20.

Formed vertically within the engine block 12 is the engine cylinder 25 which continues upward intc the engine cylinder extension 26 formed in the lower head plate 14. Reciprocably mounted within each of the cylinders 25 is a conventional piston 27 pivotally connected through the connecting rod 28 to the crank arm 29 fixed upon the crankshaft 17 (FIG. 4).

A spark plug 30 extends through the lower head plate 14 7 and is received within a firing well or cavity 31 formed within the cylinder extension 26 for periodic ignition of the compressed gases within the cylinder extension 26. The spark plug 30 may be connected to an ignition cable 32, illustrated in FIGS. 2 and 7.

Formed in the valve head 13, and specifically in the bottom portion of the intermediate or middle head plate 15 are a pair of elongated, parallel, horizontal valve chambers 33 and 34 extending across and in fluid communication with the opening or mouth of the cylinder extension 26. Longitudinally, slidably mounted within the intake chamber 33 is an intake elongated valve plate 35. Likewise, longitudinally, slidably movable within the exhaust valve chamber 34 is an elongated, rectangular exhaust valve plate 36. Each of the valve plates 35 and 36 is shorter than the length of the corresponding valve chambers 33 and 34. However, each of the valve plates 35 and 36 is substantially the same width as its corresponding valve chamber 33 and 34 to permit snug, but slidable longitudinal movement of the valve plate within its corresponding valve chamber.

If desired, both valve plates 35 and 36 may be longitudinally slidably mounted in side-by-side, edge-abutting relationship within a single close-fitting valve chamber.

Figure 7:
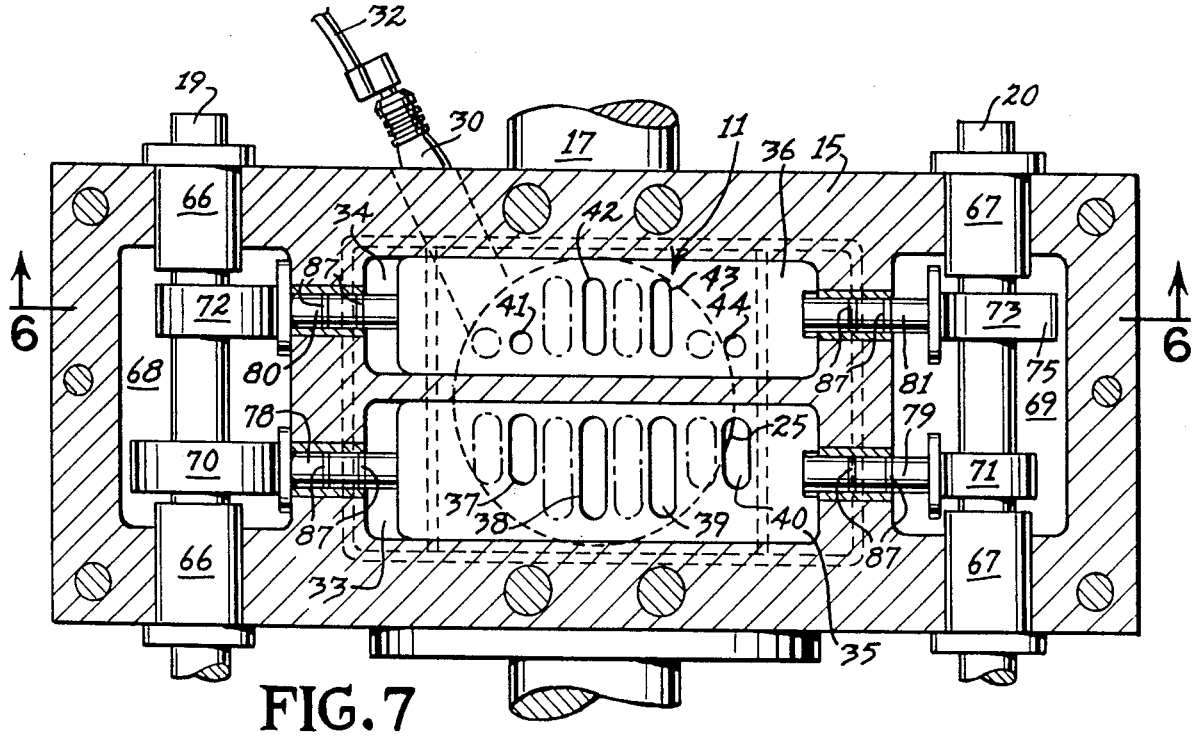
FIG. 7 is a fragmentary section taken along the line 7—7 of FIG. 6.

Formed within the intake valve plate 35, as illustrated in FIGS. 5 and 7, are a plurality (four shown) of longitudinally spaced, transversely extending, movable intake valve ports 37, 38, 39, and 40. In like manner, a plurality (four shown) of longitudinally spaced movable exhaust valve ports 41, 42, 43, and 44 are formed in the exhaust valve plate 36, as best illustrated in FIGS. 6 and 7.

Formed through intermediate head plate 15 above and in fluid communication with the intake valve chamber 33 are a plurality of fixed intake valve ports 45, 46, 47, and 48, as best illustrated in FIGS. 4 and 5. As illustrated in FIG. 5, each of the fixed valve ports 45–48 is identical in cross-sectional size and shape to the corresponding movable intake valve ports 37–40, and are adapted to register with each of the corresponding movable intake valve ports 37-40 when the intake valve plate 35 is in its open position, as illustrated in FIG. 4, for open fluid communication between all of the intake valve ports and the interior of the cylinder 25.

Each of the fixed vertical intake valve ports 45–48 is in fluid communication with the corresponding intake ducts 49, 50, 51, and 52, respectively, formed in the upper head plate 16, as illustrated in FIG. 4. The upper ends of the intake ducts 49, 50, 51, and 52 converge into a common intake supply duct 53 fixed to a cap plate 54 which is bolted to the top surface of the upper head plate 16, as illustrated in FIGS. 1 and 4. The intake supply duct 53 is connected to the carburetor 55 which receives gasoline through the fuel line 56 for mixture with air to form the appropriate fuel mixture for the engine cylinder 25.

In a similar manner, fixed exhaust valve ports 57, 58, 59, and 60 are formed vertically through the intermediate head plate 15, in fluid communication with and above the exhaust valve chamber 34, and spaced transversely of the fixed intake valve ports 45–48. These fixed exhaust valve ports 57–60 are identical in size and shape to their corresponding movable exhaust valve ports 41–44, respectively, for registry with their corresponding movable exhaust valve ports 41–44 in their open position, not shown, but similar to the registry between the intake valve ports illustrated in FIG. 4. Thus, when the exhaust valve plate 36 is in its open position, the fixed exhaust valve ports 57–60 are in registry with their corresponding movable exhaust valve ports 41–44 for open fluid communication between the fixed valve ports 57–60 and the interior of the cylinder 25 and the cylinder extension 26. The closed position of the exhaust valve plate 36, showing the movable exhaust valve ports 41–44 not in registry with the fixed exhaust valve ports 57–60, is shown in FIGS. 6 and 7.

Communicating with the corresponding fixed exhaust valve ports 57–60 are corresponding exhaust ducts 61–64 which are of the same size and shape as the fixed exhaust valve ports 57–60, but angle inwardly upwardly to converge in fluid communication with the exhaust supply duct 65. The exhaust supply duct 65 is also fixed to and extends through the cap plate 54 and projects outwardly into communication with the exhaust manifold, not shown.

Each of the cam shafts 19 and 20 is journaled respectively in bearings 66 and 67 within the valve head 13 and extend through corresponding cam chambers 68 and 69. Fixed to each of the cam shafts 19 and 20, respectively, are the intake cams 70 and 71 and the exhaust cams 72 and 73. Each of the cams 71 and 73 is provided with a pointed radially projecting lobe 74 and 75, respectively. Each of the cams 70 and 72 is provided with an arcuate lobe 76 and 77 which is substantially circular over approximately a 180 deg. arc with a radius greater than the other peripheral portion of the respective cam. As best illustrated in FIG. 4, the obes 74 and 75 are circumferentially staggered approximately 90 deg., while the large lobes 76 and 77 are also circumferentially staggered approximately 90 deg.

Each of the cams 70–73 is in substantially constant engagement with corresponding push rods 78, 79, 80, and 81, respectively, which in turn engage a corresponding end of an intake valve plate 35 and an exhaust valve plate 36, as illustrated in FIG. 7. Each of the push rods 78–81 is slidably received in an elongated sleeve 82 formed in a corresponding opening within the intermediate head plate 15. The cams 70–73 and their corresponding lobes are so arranged that when the cam shafts 19 and 20 are rotated continuously in the same direction of the arrows disclosed in the drawings, the intake valve plate 35 will be in its open position, as disclosed in FIG. 4, and the exhaust valve plate 36 will be in its closed position, during the initial intake cycle of the four cycle internal combustion engine 10. Then when the piston 27 starts upward in the cylinder 25 during the second compression cycle, each of the cam shafts 19 and 20 will have rotated through 90 deg. so that both intake and exhaust valve plates 35 and 36 will be in their closed positions, as illustrated in FIGS. 6 and 7. When the spark plug 30 is energized to ignite the fuel gases within the cylinder 25, and the piston 27 is again driven downwardly by the exploding gases to drive the crankshaft 17, the cam shafts 19 and 20 will have rotated through another 90 deg. to maintain both intake and exhaust valve plates 35 and 36 in their closed positions. Then in the fourth or exhaust cycle, when the piston 27 again moves upwardly, the cam shafts 19 and 20 will have rotated through their final 90 deg. arc to complete their revolution and open the exhaust valve plate 36 but maintain the intake valve plate 35 closed, as illustrated in FIGS. 2 and 3.

As illustrated in FIG. 1, the cog pulleys 22 and 23 have twice the diameter of the cog pulley 21 so that there is one revolution of each of the cam shafts for each two revolutions of the crankshaft 17.

It will be understood that in appropriate circumstances, either camshaft and its corresponding cams may be replaced by spring mechanisms for biasing each of the valve plates against the action of a single cam shaft.

As illustrated in the drawings, various sealing elements may be utilized to limit or prohibit the flow or leakage of gases, such as the cylinder 0-rings 83 and 84, and gaskets 85 and 86, and the 0-rings 87 fitted around each push-rod 78, 79, 80, and 81 and seated against the inner surface of the corresponding sleeve 82. Furthermore, the pressure of the gases within the cylinder 25 will seat the slide valve plates 35 and 36 upward against the bottom surfaces of the valve seat plates 93 and 94 fixed within the respective valve chambers 33 and 34.

As best illustrated in FIG. 7, the four movable intake valve ports 37–40 are uniformly longitudinally spaced, with a minimum longitudinal dimension and a maximum transverse dimension. A maximum transverse dimension of the movable intake ports 37–40 is determined by the diametrical extent or the circumference of the cylinder 25 or cylinder extension 26, as illustrated by the hidden-line position 25 of the cylinder in FIG. 7, when the intake valve plate 35 is in its open position. In FIG. 7, the intake valve plate 35 lies in its closed position with the movable intake valve port 40 outside the perimeter of the cylinder 25. However, when the intake valve plate 35 is in its closed position, all of the intake valve ports 37–40 lie within the perimeter of the vertical extension of the engine cylinder 25 so that all of the intake valve ports are simultaneously in fluid communication with the interior of the cylinder 25 when the intake valve plate 35 is in its open position. Thus, the maximum transverse dimensional limit of each of the movable intake valve ports 37–40 is the perimeter of the cylinder 25, to allow maximum flow of the fuel mixture into the cylinder.

On the other hand, the longitudinal dimension of each of the movable intake ports 37–40 is made as small as possible to permit limited longitudinal travel of the intake valve plate 35 in order to minimize the time required for the valve preparation for the intake cycle. On the other hand, the longitudinal dimensions of the movable intake valve ports 37–40 should not be so small as to restrict the flow of the fuel mixture through the ports in their open position. Furthermore, the narrow longitudinal spacing between the intake ports 37–40 would be limited by the strength and integrity of the solid portion of the plate between the ports and an adequate sealing area between the ports for sealing off the fixed intake valve ports 57–60, as illustrated in FIG. 6.

As illustrated in FIG. 7, the movable intake valve ports 37–40 are of different widths, in order to obtain maximum advantage of the lateral or transverse extent of the ports within the perimeter of the vertical extension of the cylinder 25. As illustrated in FIG. 7, there are four movable intake valve ports 37, 38, 39, and 40, and the transverse dimension of the middle ports 38 and 39 is substanially greater than the transverse extent of the opposite end ports 37 and 40.

The construction of the movable exhaust valve ports 41–44 is similar to the structure of the movable intake valve ports 37–40. The exhaust valve ports 41-44 are smaller, specifically occupying about 80% of the total area of the four intake valve ports 37–40. The longitudinal dimensions of the corresponding movable exhaust valve ports 41–44 is limited according to the same criteria as the longitudinal dimensions of the intake valve ports. Moreover, the transverse dimensions of the movable exhaust valve ports 41–44 is as great as possible, but again is limited by the perimeter of the imaginary vertical extension of the engine cylinder 25, as illustrated in FIG. 7, when the exhaust valve ports 41–44 are in their open position, not shown.

Although because of the circular configuration of the wall of the cylinder 25, the two middle movable exhaust valve ports 42 and 43 have substantially greater transverse dimension than the end movable exhaust valve ports 41 and 44. Although the end exhaust valve ports 41 and 44 are shown as circular, they could be transversely oblong, having a similar shape as the middle exhaust valve ports 42 and 43, provided they do not extend beyond the perimeter of the cylinder 25. Again, the spacing between the exhaust valve ports have the same limitations as the spacing between the intake valve orts, depending upon the strength of the solid portions of the exhaust valve plate 36 between these ports and an adequate sealing area between the exhaust valve ports.

Although only a single cylinder 25 has been illustrated in the engine 10, nevertheless, it will be understood that any number of engine cylinders may be utilized in the same engine block 12, each being provided with the same slidable valve apparatus as illustrated with the single cylinder 25 disclosed in the drawings.

The valve head 13 may be provided with a cooling system including water cooling channels 88, such as illustrated in FIGS. 4, 5, and 6. Other portions of the engine block 12, as well as the valve head 13 may be provided with appropriate cooling channels for circulation of cooling water supplied through an inlet conduit 89 and discharged through a discharge conduit 90.

Accordingly, a sliding valve apparatus 11 has been designed in which the slide valves move substantially a lesser distance than slide valves heretofore known, in order to open and close the opening or mouth of the engine cylinder during the respective intake and exhaust cycles. Such a shorter travel for the slidable intake and exhaust valve plates incorporating the multiple valve ports permits, not only more rapid operation of the cyclical movements of the piston, but also reduces wear on the movable valve parts for each cycle, as well as improving the speed and efficiency of the engine 10.

What is claimed is:

1. In an internal combustion engine including a combustion cylinder having an opening at one end thereof, a piston mounted within the cylinder for coaxial reciprocable movement, a driven crankshaft, and a connecting rod connecting said crankshaft to said cylinder for linear reciprocable movement of said piston in response to the rotary movement of said crankshaft, a valve apparatus comprising:

(a) a valve chamber extending longitudinally across and in fluid communication with the opening in said cylinder, (b) an intake valve plate having a longitudinal axis mounted within said valve chamber for slidable, reciprocable, longitudinal movement, (c) an exhaust valve plate having a longitudinal axis mounted within said valve chamber alongside said intake valve plate for slidable, reciprocable, longitudinal movement and parallel to the longitudinal axis of said intake valve plate, (d) each of said valve plates having a plurality of longitudinally spaced valve ports therein, said valve ports comprising movable intake valve ports in said intake valve plate and movable exhaust valve ports in said exhaust valve plate, (e) said valve chamber comprising a planar wall on the opposite side of said valve plates from said cylinder opening and having a plurality of fixed valve ports therethrough, said fixed valve ports being equal in number and substantially equal in size and spacing as said movable intake and exhaust valve ports, whereby said movable intake valve ports are adapted to register with their corresponding fixed valve ports when said intake valve plate is in its intake operative position for opening fluid communication between said cylinder and said corresponding fixed valve ports, said movable exhaust valve ports being adapted to register with their corresponding fixed valve ports when said exhaust valve plate is in its exhaust operative position permitting fluid communication between said cylinder and said corresponding fixed valve ports, (f) intake means communicating with said fixed intake valve ports for supplying fuel to said cylinder through said fixed intake valve ports and said movable intake valve ports in said intake operative position, (g) exhaust means for removing exhaust gases from said cylinder through said registered movable exhaust valve ports and fixed exhaust valve ports when said exhaust valve plate is in its exhaust operative position, (h) cam means operatively connected to said crankshaft and to said intake and exhaust valve plates for longitudinally and reciprocably moving said valve plates for opening and closing fluid communication of said cylinder with said fixed intake valve ports and said fixed exhaust valve ports, respectively, periodically.

2. The invention according to claim 1 in which at least one of each of said movable intake valve ports and said movable exhaust valve ports has a transverse dimension greater than its longitudinal dimension and which extends substantially the width of its corresponding intake and exhaust valve plates.

3. The invention according to claim 2 in which said intake valve ports occupy a greater total area than said exhaust valve ports.

4. The invention according to claim 1 in which the size and arrangement of said movable intake valve ports are fully contained within an imaginary, cylindrical perimeter forming the extension of said cylinder, when said intake valve plate is in its intake operative position.

5. The invention according to claim 1 in which the size and arrangement of said movable exhaust valve ports are fully contained within an imaginary, cylindrical perimeter forming the extension of said cylinder when said exhaust valve plate is in its exhaust operative position.

6. The invention according to claim 3 in which all of said intake valve ports have transverse dimensions greater than the corresponding longitudinal dimensions of said exhaust valve ports.

7. The invention according to claim 2 in which there are at least four movable intake valve ports and at least four movable exhaust valves ports.

8. The invention according to claim 7 in which the two middle exhaust valve ports have transverse dimensions greater than their corresponding longitudinal dimensions.

9. The invention according to claim 8 in which the transverse dimensions of each of said intake valve ports is greater than its corresponding longitudinal dimension and each of the two middle intake valve ports has a greater transverse dimension than the corresponding end intake valve ports.

10. The invention according to claim 1 in which said cam means comprises an elongated cam shaft having a pair of longitudinally spaced cams, bearing means supporting said cam shaft for rotary movement about a rotary axis adjacent one end of said valve plates and transversely of the longitudinal axes of said valve plates, operative link means between said cams and said valve plates, whereby each of said valve plates is adapted to be reciprocably moved longitudinally in response to the rotary movement of said cam shaft.

* * * * *